US012140006B2

(12) United States Patent
Bencze et al.

(10) Patent No.: US 12,140,006 B2
(45) Date of Patent: Nov. 12, 2024

(54) ENHANCED MECHANICAL SHAFT SEAL PROTECTOR FOR ELECTRICAL SUBMERSIBLE PUMPS

(71) Applicant: Halliburton Energy Services, Inc., Houston, TX (US)

(72) Inventors: András Bencze, Farnborough (GB); Hassan Mansir, Berkshire (GB)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/371,104

(22) Filed: Sep. 21, 2023

(65) Prior Publication Data

US 2024/0125218 A1 Apr. 18, 2024

Related U.S. Application Data

(63) Continuation of application No. PCT/US2022/046946, filed on Oct. 18, 2022.

(51) Int. Cl.
*E21B 43/12* (2006.01)
*E21B 43/34* (2006.01)
*F04D 13/10* (2006.01)

(52) U.S. Cl.
CPC ..... *E21B 43/128* (2013.01); *E21B 43/35* (2020.05); *F04D 13/10* (2013.01)

(58) Field of Classification Search
CPC ..... F04D 13/086; F04D 13/10; F04D 47/06; E21B 43/128; E21B 43/35
See application file for complete search history.

(56) References Cited

U.S. PATENT DOCUMENTS 3,288,075 A * 11/1966 Lung ..... F04D 13/10 415/121.2
3,289,608 A * 12/1966 Laval, Jr. ..... E21B 43/35 55/455
4,072,481 A * 2/1978 Laval, Jr. ..... E21B 43/38 96/182
4,330,306 A * 5/1982 Salant ..... E21B 43/38 96/219
4,481,020 A * 11/1984 Lee ..... B01D 19/0052 96/214

(Continued)

FOREIGN PATENT DOCUMENTS

CA 2229018 A1 * 8/1999 ..... E21B 43/128
CA 2736736 A1 * 10/2012 ..... B01D 19/0057

(Continued)

OTHER PUBLICATIONS

Foreign Communication from Related Application—International Search Report and Written Opinion of the International Searching Authority, International Application No. PCT/US2022/046946, dated Jul. 12, 2023, 10 pages.

*Primary Examiner* — Alexander B Comley
(74) *Attorney, Agent, or Firm* — Conley Rose, P.C.; Rodney B. Carroll

(57) ABSTRACT

Disclosed is an apparatus that when installed with an Electrical Submersible Pump (ESP) for fluid production protects an electric motor of the ESP from the effect of solids on a mechanical shaft seal of a motor protector of the ESP. Disclosed are features of the apparatus that dynamically filters the solids and prevents them from contacting or accumulating at the vicinity of the mechanical shaft seal.

23 Claims, 10 Drawing Sheets

(56) References Cited

U.S. PATENT DOCUMENTS 4,913,630 A * 4/1990 Cotherman ..... E21B 43/128 417/313
5,314,018 A * 5/1994 Cobb ..... B01D 21/267 166/105.1
5,525,146 A * 6/1996 Straub ..... E21B 43/121 96/217
6,066,193 A * 5/2000 Lee ..... E21B 43/38 96/216
6,155,345 A * 12/2000 Lee ..... E21B 43/121 96/217
6,216,788 B1 * 4/2001 Wilson ..... E21B 43/38 166/105.1
6,227,796 B1 5/2001 Markovitch
6,382,317 B1 * 5/2002 Cobb ..... E21B 43/35 96/216
6,412,563 B1 * 7/2002 William St. Clair ... E21B 43/35 166/105.3
7,695,548 B1 * 4/2010 Grubb ..... E21B 43/128 96/219
8,757,256 B2 * 6/2014 Li ..... B01D 17/0217 166/265
9,039,356 B1 * 5/2015 Nowitzki ..... F04D 1/06 415/169.1
11,408,432 B2 * 8/2022 Watson ..... F04D 29/0413
2002/0134554 A1 * 9/2002 Schrenkel ..... E21B 43/38 166/372
2004/0144534 A1 * 7/2004 Lee ..... F04D 13/10 166/66.4
2005/0214109 A1 9/2005 Grande, III et al.
2005/0281683 A1 * 12/2005 Brown ..... F04D 29/181 417/313
2007/0051509 A1 * 3/2007 Selph ..... F04D 29/708 166/50
2009/0266561 A1 * 10/2009 Cobb ..... E21B 43/38 166/66.4
2010/0064893 A1 * 3/2010 Hopper ..... B01D 17/0217 210/787
2010/0175869 A1 * 7/2010 Cobb ..... B04C 5/28 166/227
2012/0006543 A1 * 1/2012 Cox ..... E21B 43/38 166/265
2012/0269614 A1 * 10/2012 Bassett ..... F04D 7/04 415/73
2013/0032352 A1 * 2/2013 Raglin ..... E21B 43/35 166/227
2013/0039782 A1 * 2/2013 Brown ..... F04D 29/445 417/313
2013/0315517 A1 * 11/2013 Tetzlaff ..... F04D 13/08 384/226
2013/0319956 A1 * 12/2013 Tetzlaff ..... F04D 13/10 210/512.1
2014/0216720 A1 * 8/2014 Wang ..... E21B 43/121 96/216
2014/0219828 A1 * 8/2014 Ford ..... B01D 17/0217 417/54
2016/0138380 A1 * 5/2016 McCoy ..... E21B 43/38 166/265
2017/0241421 A1 * 8/2017 Markovitch ..... F04D 7/045
2017/0321806 A1 * 11/2017 Collins ..... E21B 43/38
2018/0023378 A1 * 1/2018 Echenagucia Cioppa ..... E21B 43/121 166/105.5
2018/0156241 A1 * 6/2018 Head ..... F04D 29/0473
2018/0258749 A1 * 9/2018 Grande, III ..... E21B 43/38
2018/0347335 A1 * 12/2018 Hemstock ..... E21B 43/35
2019/0309768 A1 * 10/2019 Todd ..... E21B 43/35
2020/0048998 A1 * 2/2020 Deroche ..... B04C 5/085
2020/0325757 A1 * 10/2020 Hassan ..... E21B 43/35
2020/0378235 A1 * 12/2020 Gonzales ..... E21B 43/38
2021/0324722 A1 * 10/2021 Xiao ..... E21B 43/38
2022/0119584 A1 * 4/2022 Burdzy ..... C08G 18/7678
2022/0243564 A1 * 8/2022 Tang ..... E21B 41/0099

FOREIGN PATENT DOCUMENTS

CA 2905848 A1 * 3/2016 ..... E21B 43/128
CN 2263225 Y * 9/1997 ..... F04D 13/10
CN 200955384 Y * 10/2007
CN 113864204 A * 12/2021
RU 2587204 C1 * 6/2016 ..... E21B 43/38
RU 2632607 C1 * 10/2017
WO WO-2022046124 A1 * 3/2022 ..... E21B 43/128

* cited by examiner

ENHANCED MECHANICAL SHAFT SEAL PROTECTOR FOR ELECTRICAL SUBMERSIBLE PUMPS

CROSS REFERENCE TO RELATED APPLICATIONS

This application is a continuation of and claims priority to PCT/US2022/046946 filed Oct. 18, 2022 and entitled, "Enhanced Mechanical Shaft Seal Protector for Electrical Submersible Pumps," which is incorporated by reference herein in its entirety.

BACKGROUND

Electric Submersible Pump (ESP) systems provide an efficient and reliable artificial-lift method for pumping a variety of wellbore fluids from wellbores. The ESP system typically comprises a multi-staged centrifugal pump, a motor protector (also referred to as "seal-section") and a motor in an enclosed unit. A key component of the seal-section is a mechanical shaft seal that relies on sliding surfaces to maintain a seal between the wellbore area and the inside containing a clean dielectric fluid.

When wellbore fluids are drawn into the mechanical shaft seal area from the open pump intake, sand and other solids can accumulate in close proximity to the shaft seal. The high concentration of solid particles in the vicinity of the shaft seal degrades its performance characteristics and compromises the sealing surfaces resulting in failure. The accumulation of solids may also plug the outlet of the check valve that provides a vent for the expanding dielectric fluid into the wellbore. This compromises the pressure compensations mechanism and causes a pressure build up inside seal section that may result in the seal faces separation exacerbating the wear and scoring of the seal faces when solid particles are present. When this occurs, wellbore fluid and solids enter the clean dielectric fluid section of the seal compromising its integrity.

BRIEF DESCRIPTION OF THE DRAWINGS

FIG. 6 shows the top mechanical shaft seal 140 of the protector.

DETAILED DESCRIPTION OF THE INVENTION

Figure 1:
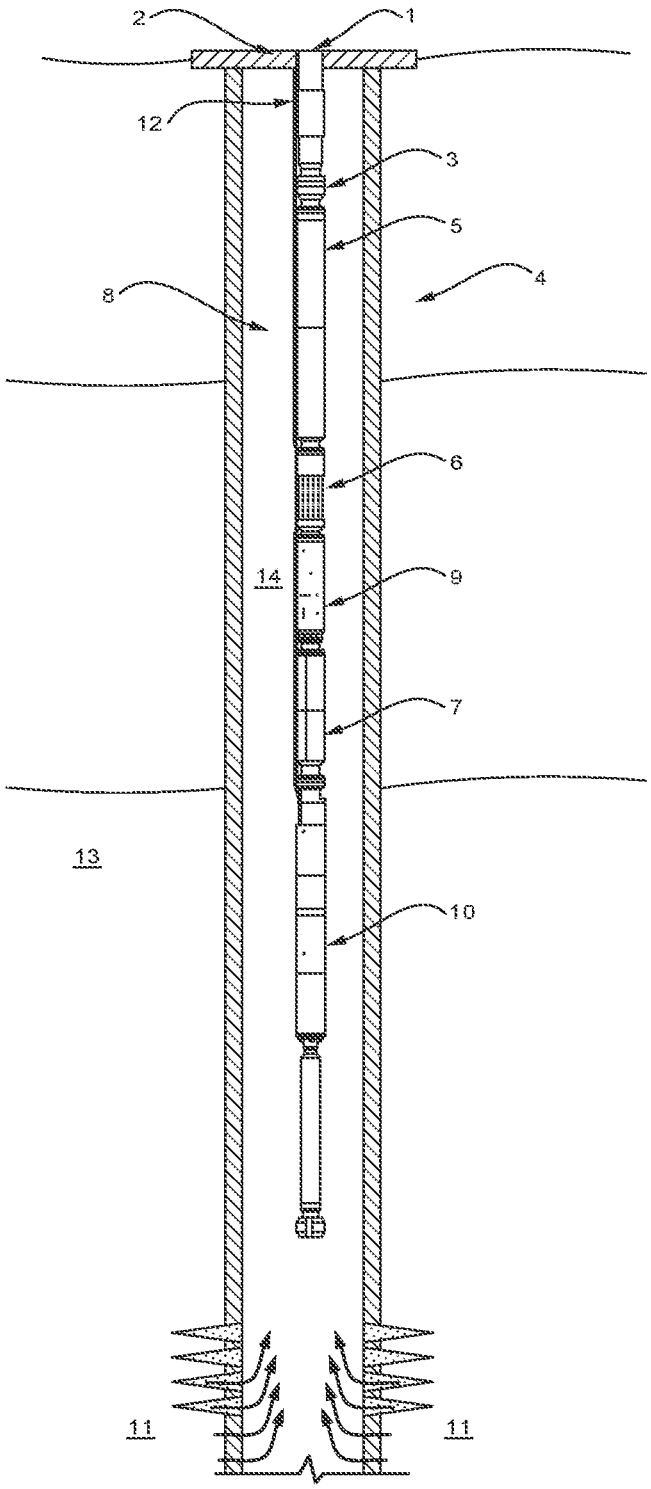
FIG. 1 is a front elevation view of an Electric Submersible Pumping (ESP) system disclosed in a wellbore, according to an embodiment of the present invention.

In the following description, numerous details are set forth to provide an understanding of the present invention. However, it will be understood by those of ordinary skill in the art that the present invention may be practiced without these details and that numerous variations or modifications from the described embodiments may be possible.

The present invention generally relates to an apparatus and method for reducing detrimental effects of sand laden wellbore fluid on a motor protector mechanical shaft seal. The system and method are useful with, for example, a variety of downhole production systems, such as electric submersible pumping systems. However, the devices and methods of the present invention are not limited to use in the specific applications that are described herein.

A solids separator taught herein provides a first stage of solids separation that exhausts coarse grained solids out of the solids separator out into the wellbore and a second stage of solids separation that exhausts fine grained solids out of the solids separator out of exhaust ports into the wellbore. Wellbore fluid enters the solids separator near an uphole end of the solids separator, flows downhole within the solids separator to the first stage of solids separation and from there downhole within the solids separator to the second stage of solids separation. At the downhole end of the second stage of solids separation, the coarse and fine solids have been removed from or greatly reduced in the wellbore fluid, and it is this relatively clean wellbore fluid that is circulated to a clean fluid chamber within a downhole end of the solids separator that encloses the motor protector mechanical shaft seal.

The exhaust ports penetrate the housing of the solids separator at an angle, such that the solids carrying fluid exiting the exhaust ports exit at an angle that may generate turbulence in the wellbore fluid surrounding the outside of an electric submersible pump (ESP) assembly comprising an electric motor, a motor protector, the solids separator, and a pump. This turbulence can provide the benefit that a slug of solids does not get ingested into the solids separator and/or into a fluid intake of the pump and cause the solids separator or the pump to clog or to seize up and jam. The risk of ingesting a slug of solids is greatest for an ESP assembly lying on its side in a horizontal portion of a wellbore.

The second stage of solids separation of the solids separator comprises a plurality of conical bladeless impellers that are coupled to a drive shaft of the solids separator. When the drive shaft of the solids separator is turning, the conical bladeless impellers rotate and impart rotating motion to the fluid based on the boundary layer effect associated with fluids in contact with surfaces. The solids entrained in the fluid, because they are denser, tend to migrate to the outside of the rotating conical bladeless impellers and be ejected with some of the fluid out the exhaust ports adjacent to the outside edges of the conical bladeless impellers. The conical bladeless impellers define small apertures proximate the drive shaft that allow fluid to flow between the conical bladeless impellers. Each conical bladeless impeller angles downhole away from the drive shaft. When the solids separator is disposed in an at least partly vertical position, and the solids separator is shutdown (e.g., when electric power to the electric motor is turned off), this downhole slanting of the conical bladeless impellers advantageously promotes settling solids within the second stage of separation to slide outwards, downhole along the upper surface of the conical bladeless impellers, fall to a base of the solids separator, and be caught in a well formed between an outside of the housing or an outside of the base and an upper dam that forms a raised lip proximate the drive shaft, preventing the solids from jamming the solids separator on start-up.

The drive shaft of the solids separator defines an axial bore that promotes circulation of fluid via an inlet transverse bore uphole of the clean fluid chamber and via an outlet transverse bore disposed proximate the middle two conical bladeless impellers. Thus, wellbore fluid flows internally within the solids separator downhole via a flow channel on an outside of a bearing bushing retained within the base (see FIG. 4B, flow channels 320, 322), flows into the inlet transverse bore, flows uphole within the axial bore, and out the outlet transverse bore into a middle two conical bladeless impellers. In an embodiment, the solid separator comprises six conical bladeless impellers and the outlet transverse bore opens out between the third conical bladeless impeller and the fourth conical bladeless impeller (where the furthest uphole conical bladeless impeller is the first impeller and the furthest downhole conical bladeless impeller is the sixth impeller). The wellbore fluid also circulates between the bearing bushing and a bearing sleeve retained by an interior of the bearing bushing, due to pumping action of the journal. This circulation of fluid contributes to lubricating and cooling the bearings of the solids separator disposed near the downhole end of the solids separator and also contributes to further cleaning of the wellbore fluid that is provided to the clean fluid chamber. Fluid is free to flow into or out of the clean fluid chamber via an annulus between the interior of the base of the solids separator and the outside of the drive shaft of the solids separator.

Referring generally to FIG. 1, an example of a pumping system 4, such as an electric submersible pumping system, is illustrated according to an embodiment of the present invention. Pumping system 4 may comprise a variety of components depending on the particular application or environment in which it is used. In this example, however, pumping system 4 includes a centrifugal submersible pump 5, a submersible motor 10 and a motor protector 7.

Pumping system 4 is designed for deployment in a wellbore 14 within a geological formation 13 containing desirable production fluids, such as water or crude. A wellbore 14 typically is drilled and lined with a wellbore casing 8. Wellbore casing 8 includes a plurality of openings or perforations 11 through which production fluids flow from formation 13 into wellbore 14. The production fluid may be referred to as wellbore fluid once it has flowed out of the formation 13 into the wellbore 14.

Pumping system 4 is deployed in wellbore 14 by a deployment system 2 that may have a variety of forms and configurations. For example, deployment system 2 may comprise tubing, such as coil tubing or production tubing, connected to pump 5 by a connector 3. Electric power is provided to submersible motor 10 via an electric power cable 12. Motor 10, in turn, powers pump 5 which draws wellbore fluid in through a pump intake 6, and pumps the wellbore fluid (which includes production fluid) to the surface via tubing 1.

It should be noted that the illustrated submersible pumping system 4 is merely an example. Other components can be added to this system and other deployment methods may be implemented (i.e. rigless—wireline). Additionally, the wellbore fluids may be pumped to the surface through tubing 1 or through the annulus defined by the region between deployment system 2 and wellbore casing 8. In any of the many potential configurations of submersible pumping system 4, motor protector 7 is used to seal the submersible motor 10 from fluid in wellbore 14 and to generally balance the internal pressure within submersible motor 10 with the external pressure in wellbore 14.

Figure 2:
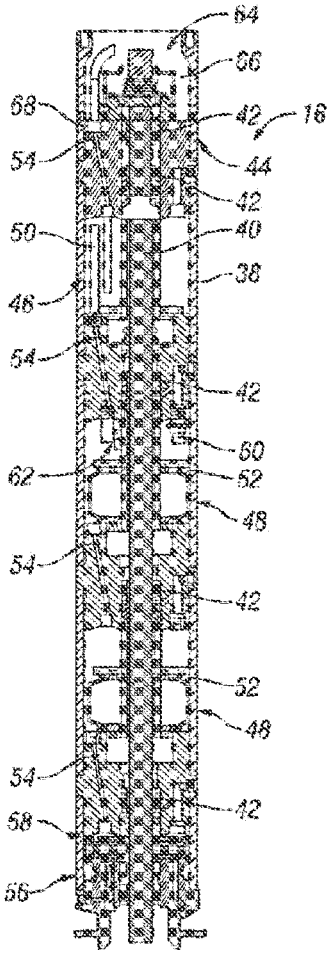
FIG. 2 is a longitudinal sectional view taken generally along an axis of a motor protector 7 illustrated in FIG. 1

Referring generally to FIG. 2, an embodiment of motor protector 7 is illustrated in greater detail. Motor protector 7 comprises an outer housing 38 within which a drive shaft 40 is rotatably mounted via a plurality of bearings 42, such as journal bearings. Outer housing 38 may be formed of one or more housing components. Also, the motor protector 7 is divided into a plurality of sections, including a head section 44 disposed generally at an upper end of the protector. An additional section (or sections) is disposed below head section 44 and functions as a fluid separation section to separate wellbore fluid that may enter head section 44 from internal motor oil used to lubricate submersible motor 10. The sections also facilitate balancing of internal and external pressures. In the embodiment illustrated, a labyrinth section 46 is disposed below head section 44, and a pair of elastomeric bag sections 48 are disposed below labyrinth section 46.

Labyrinth section 46 comprises a labyrinth 50 tubes that uses the difference in specific gravity of the well fluid and the internal motor oil to maintain separation between the internal motor oil and the well fluid. Each bag section uses an elastomeric bag 52 to physically isolate the internal motor oil from the wellbore fluid. It should be noted that the motor protector sections may comprise a variety of section types. For example, the motor protector may comprise one or more labyrinth sections, one or more elastomeric bag sections, combinations of labyrinth and bag sections as well as other separation systems. A series of fluid ports or channels 54 connect each section with the next sequential section. In the embodiment illustrated, a port 54 is disposed between head section 44 and labyrinth section 46, between labyrinth section 46 and the next sequential bag section 48, between bag sections 48 and between the final bag section 48 and a lower end 56 of motor protector 7.

Motor protector 7 may comprise a variety of additional features. For example, a thrust bearing 58 may be deployed proximate lower end 56 to absorb axial loads applied on shaft 40 by the pumping action of submersible pump 5. The protector also may comprise an outward relief mechanism 60, such as an outward relief valve. The outward relief valve releases excessive internal pressure that may build up during, for example, the heating cycle that occurs with start-up of electric submersible pumping system 10. Motor protector 7 also may comprise an inward relief mechanism 62, such as an inward relief valve. The inward relief valve relieves excessive negative pressure within the motor protector. For example, a variety of situations, such as system cool down, can create substantial internal pressure drops, i.e. negative pressure, within the motor protector. Inward relief mechanism 62 alleviates the excessive negative pressure by, for example, releasing external fluid into the motor protector to reduce or avoid mechanical damage to the system caused by this excessive negative pressure.

Figure 3:
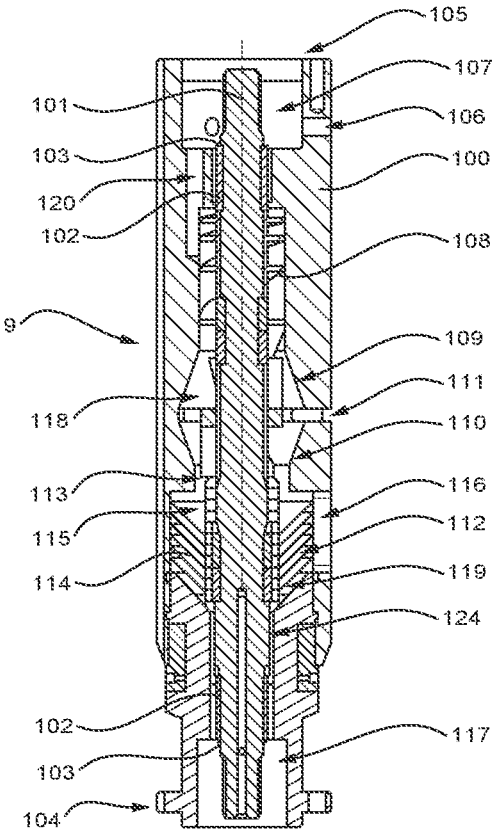
FIG. 3 is a longitudinal section side view of the solids filtration apparatus as illustrated in FIG. 1.
Figure 5:
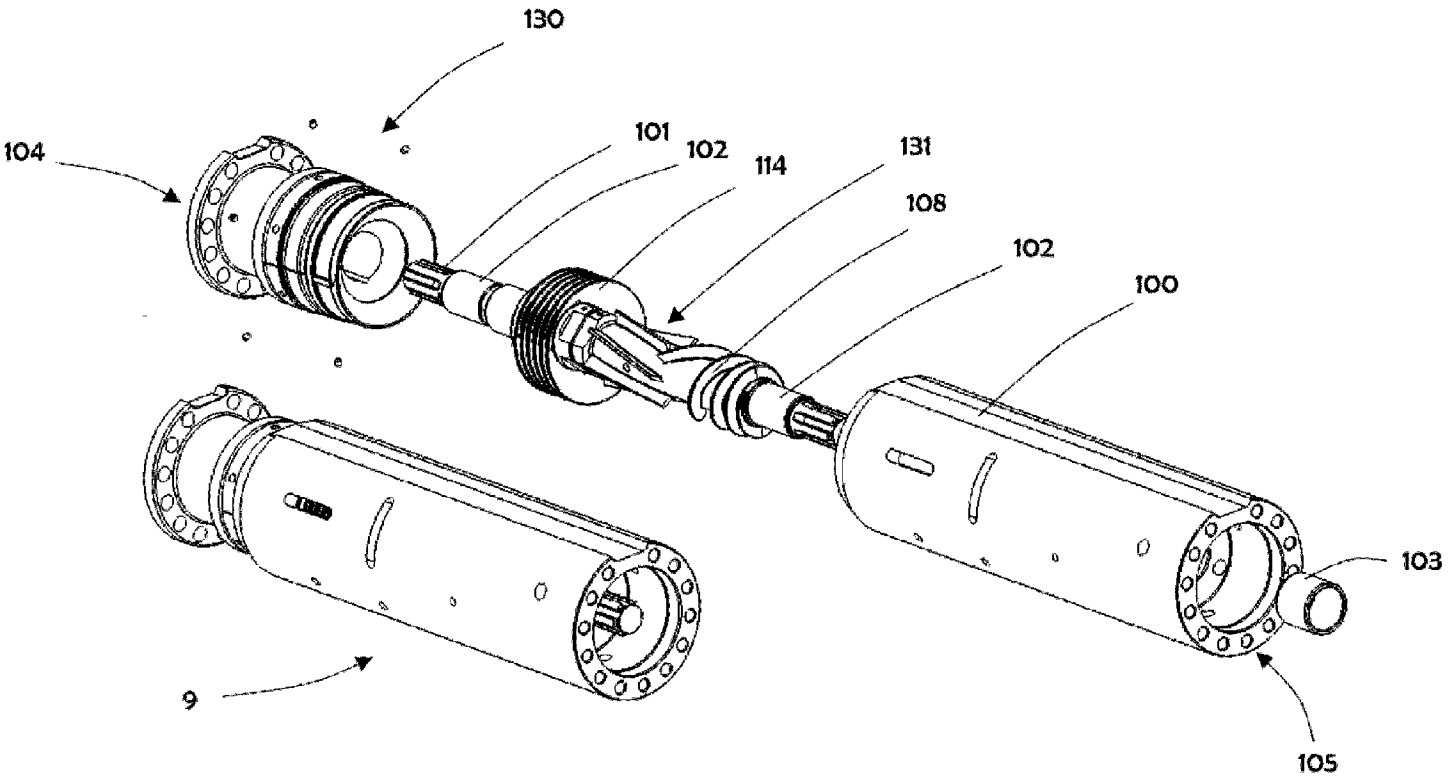
FIG. 5 is an exploded view of the elements of a solids separator as illustrated in FIG. 3.

Referring to FIGS. 3 and 5 there is shown a housing 100 with a flange 104 which connects to the output of a motor, typically via a protector (e.g., protector 7, not here shown). The assembly has a central bore, and a drive shaft 101 passes through this central bore, which is mounted in bearings 102 and 103 (journal bearing). The outer housing 100 extends to an upper flange 105. Ports 106 allow wellbore fluid to be drawn into the chamber 107 which is the inlet to the flow inducer-separator 108 through axial ports 120. The flow inducer-separator rotates with the drive shaft 101. The flow inducer may be a rotating cyclone (e.g., a helical screw or fin disposed on an outer surface of drive shaft 101) or a centrifuge. The flow inducer-separator provides kinetic energy to the fluid and the solids are transferred to the first separation zone 118. Slopes 109 and 110 lead towards a first plurality of exit ports 111. The solids will travel on the slopes 109 and 110 before existing the first separation cavity 118. With the turning of the flow inducer-separator 108, as fluid and suspension mixture is introduced into the inducer-separator from the chamber 107, the separator draws the mixture downwards and separates the solids and water to flow along the slopes 109 and 110 while the lower density fluid will continue its flow to the second separation zone 112.

The fluid with finer solids passes forward along the device through the inlet 113 into the second separation zone 112. The solids in the mixture will be filtered by the action of a series of funnel shaped centrifugal impellers 114. The clean fluid remains near the drive shaft 101 and the finer solid exits the cavity 115 through a second plurality of exit ports 116 in the housing 100. The clean fluid travels axially through ports 119 in the centrifugal impellers 114 and then through an annular gap 124 and flows through bearings 102 and 103 and into clean fluid chamber 117. Additional holes in the housing, not shown, will allow more clean fluid in the clean fluid chamber 117.

The centrifugal impellers 114 are a series of equally spaced similar frustoconical shapes which are each orientated such that the smaller diameter of the frustoconical shape is lower than (e.g., downhole of) the larger diameter of the frustoconical shape (assuming a vertical wellbore), each impeller partially fitting within the neighbouring impellers as shown.

Figure 4A:
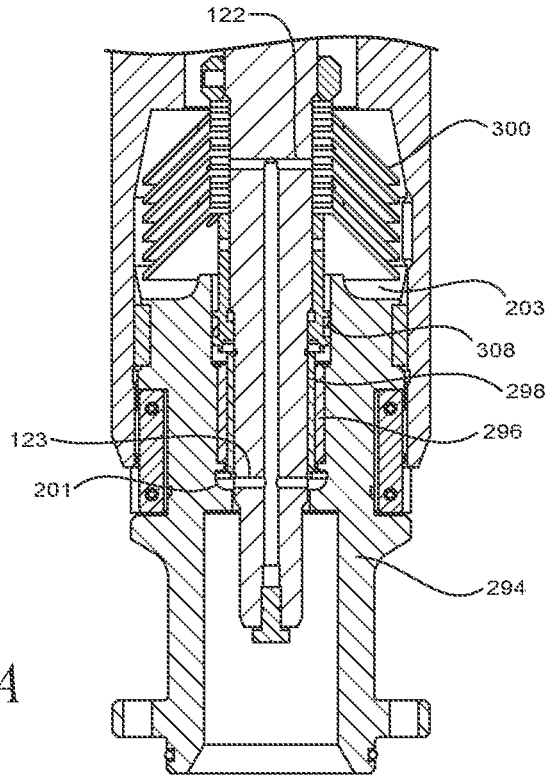
FIG. 4A is a side view of another embodiment of the solid filtration apparatus also illustrative of the detail of bottom section shown in FIG. 3.

It has been found that the separation in the second separation zone can be improved by orienting the funnels in the opposite direction, such that the smaller diameter of the frustoconical shape 214 is above (e.g., uphole of) the larger diameter of the frustoconical shape when the assembly is disposed in a vertical wellbore, as shown in FIG. 4A. The general flow of wellbore fluid is into the port 106 located towards the uphole end of the solids separator 9, into the chamber 107, downhole through the flow inducer-separator 108, downhole into the first separation cavity 118. Some of the wellbore fluid and most of the coarse solids exit via the first plurality of exit ports 111. The remaining wellbore fluid flows downhole and through and/or over the conical bladeless impellers 300. Some of the remaining wellbore fluid along with mostly fine solids are exhausted out the second plurality of exit ports 116. Remaining wellbore fluid may be circulated downhole through a flow channel on the outside of the bearing bushing 296 and downhole between the inside of the bearing bushing 296 and the outside of the bearing sleeve 298, enter the first transverse bore 123, flow uphole inside the axial bore 121, and flow out the second transverse bore 122.

Turning now to FIG. 4A, an improved downhole end of the solids separator 9 is described. Here the conical bladeless impellers 300 slant outwards in a downhole direction. A base 294 of the solids separator 9 is threadingly coupled to the housing 100 of the solids separator. In an embodiment, the base 294 may be machined out of a solid piece of metal. Alternatively, the base 294 may be a metal casting. The base 294 provides bolt holes at a downhole end to connect to an uphole end of the motor protector 7. The base 294 defines an upper dam 203 that defines an inner lip encircling the third drive shaft and that slopes away from the inner lip. A downhole end of the base 294, in combination with an uphole end of the motor protector 7 when the solids separator 9 and motor protector 7 are assembled together, defines the clean fluid chamber 117.

In an embodiment, the solids separator 9 comprises a helical fluid mover 308 disposed downhole of the plurality of conical bladeless impellers 300 (e.g., the fines separator). When the drive shaft 101 of the solids separator 9 turns, the helical fluid mover 308 promotes wellbore fluid flow back uphole within the solids separator 9, which reduces the amount of solids entering the clean fluid chamber 117.

In an embodiment, the solids separator 9 comprises six conical bladeless impellers 300. In another embodiment, the solids separator 9 comprises four conical bladeless impellers, five conical bladeless impellers, seven conical bladeless impellers, eight conical bladeless impellers, or some other number of conical bladeless impellers. The number of conical bladeless impellers may be selected to provide a preferred pressure differential within the downhole end of the solids separator 9 to promote circulation of wellbore fluid to the clean fluid chamber 117, between the bearing bushing 296 and the bearing sleeve 298, and up the axial bore 121. In an embodiment, the conical bladeless impellers 300 are made of metal, for example low carbon steel or stainless steel. In an embodiment, there is a space of about 2 mm to about 6 mm between each of the conical bladeless impellers 300. The conical bladeless impellers 300 may be manufactured separately and assembled to next concentrically as shown in FIG. 4A. There are apertures defined in the surfaces of the conical bladeless impellers 300 between a central aperture that receives the drive shaft 101 and a midpoint between the central aperture and an outer edge of the conical bladeless impeller 300. These apertures are described more below with reference to FIG. 10. In an embodiment, the conical bladeless impellers 300 are thin, for example between 0.1 mm thick and 2.0 mm thick, between 0.1 mm thick and 1.0 mm thick, between 0.1 mm thick and 0.5 mm thick.

The helical fluid mover 308 is coupled to the drive shaft 101 and enclosed by the inner lip of the upper dam 203. As the drive shaft 101 turns, the helical fluid mover 308 turns and resists but does not prevent wellbore fluid flowing downhole inside the solids separator 9 downhole of the conical bladeless impellers 300. This action of the helical fluid mover 308 reduces solids passage downhole through the flow channels 320, 322 and into the clean fluid chamber 117 while still allowing wellbore fluid (clean wellbore fluid) to flow downhole past the helical fluid mover 308. The base 294 retains a radial bearing that stabilizes the drive shaft 101 and comprises a bearing bushing 296 retained by the based 294 and a bearing sleeve 298 coupled to the drive shaft 101 and disposed inside of the bearing bushing 296.

In an embodiment, the drive shaft 101 defines an axial bore 121, a first transverse bore 123 that intersects the axial bore 121 downhole of the bearing bushing 296 and uphole of a throat separating the bearing chamber from the clean fluid chamber 117, and a second transverse bore 122 that intersects the axial bore 121 at a point in the axial bore 121 uphole of the base 294 and proximate the middle conical bladeless impellers 300. Said in other words, the second transverse bore 122 intersects the axial bore 121 between two middle conical bladeless impellers 300 of the plurality of conical bladeless impellers 300. In an embodiment, a plug 202 is threaded into a downhole end of the axial bore 121. The wellbore fluid can circulate downhole via the flow channels 320, 322 defined in the base 294, to the first transverse bore 123, into the first transverse bore 123, uphole inside the axial bore 121, and exit the second transverse bore 122 into a middle portion of the plurality of conical bladeless impellers 300.

A lower dam 201 is provided on the inner surface of the base 294 proximate the opening of the first transverse bore 123. A radiused curve of the lower dam 201 encourages any remaining solid particles to recirculate back up the axial bore 121 to be further processed by the conical bladeless impellers 300 and to be exhausted out the second plurality of exit ports 116. Fluid that is relatively more free of solids can flow downhole into the clean fluid chamber 117. These differences of flow direction for solids particles versus liquid relate to momentum of solid particles versus liquid.

When the pump shuts down and the drive shaft 101 stops rotating, any solids suspended in the fluid in the second separation zone 112 may settle onto the uphole facing surfaces of the conical bladeless impellers 300 to slough off by sliding downhole and away from the drive shaft 101 and fall to the upper dam 203 to be retained outside of the raised lip defined by the upper dam 203.

Figure 4B:
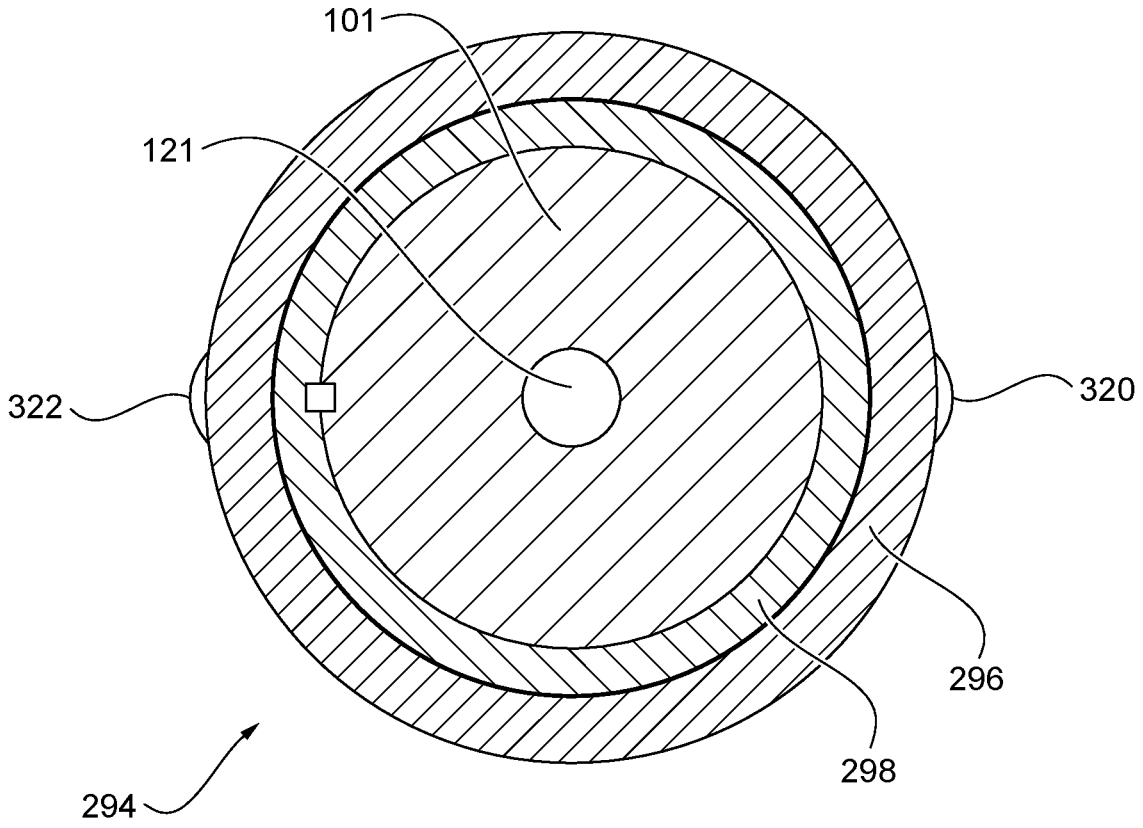
FIG. 4B shows a cross-section view of a drive shaft, bearings, and base of the solids filtration apparatus.

Turning now to FIG. 4B, more details of the downhole section of the solids separator 9 are described. The inside of the base 294 defines two axial grooves which are shown in a cross-section view as first flow channel 320 and second flow channel 322. While two flow channels 320, 322 are illustrated in FIG. 4B, in another embodiment the base 294 may define only one such axial flow channel, three such axial flow channels, four such axial flow channels, or a greater number of such axial flow channels less than 20 axial flow channels. The flow channels 320, 322 on an outside of the bearing bushing 296. The flow of clean wellbore fluid downhole in the flow channels 320, 322 and uphole between the outside of the bearing sleeve 298 and the inside of the bearing bushing 296 promotes cooling the bearing sleeve 298 and bearing bushing 296. The flow of clean wellbore fluid uphole between the outside of the bearing sleeve 298 and the inside of the bearing bushing 296 additionally provides lubrication and hydrodynamic fluid film forces.

Figure 6:
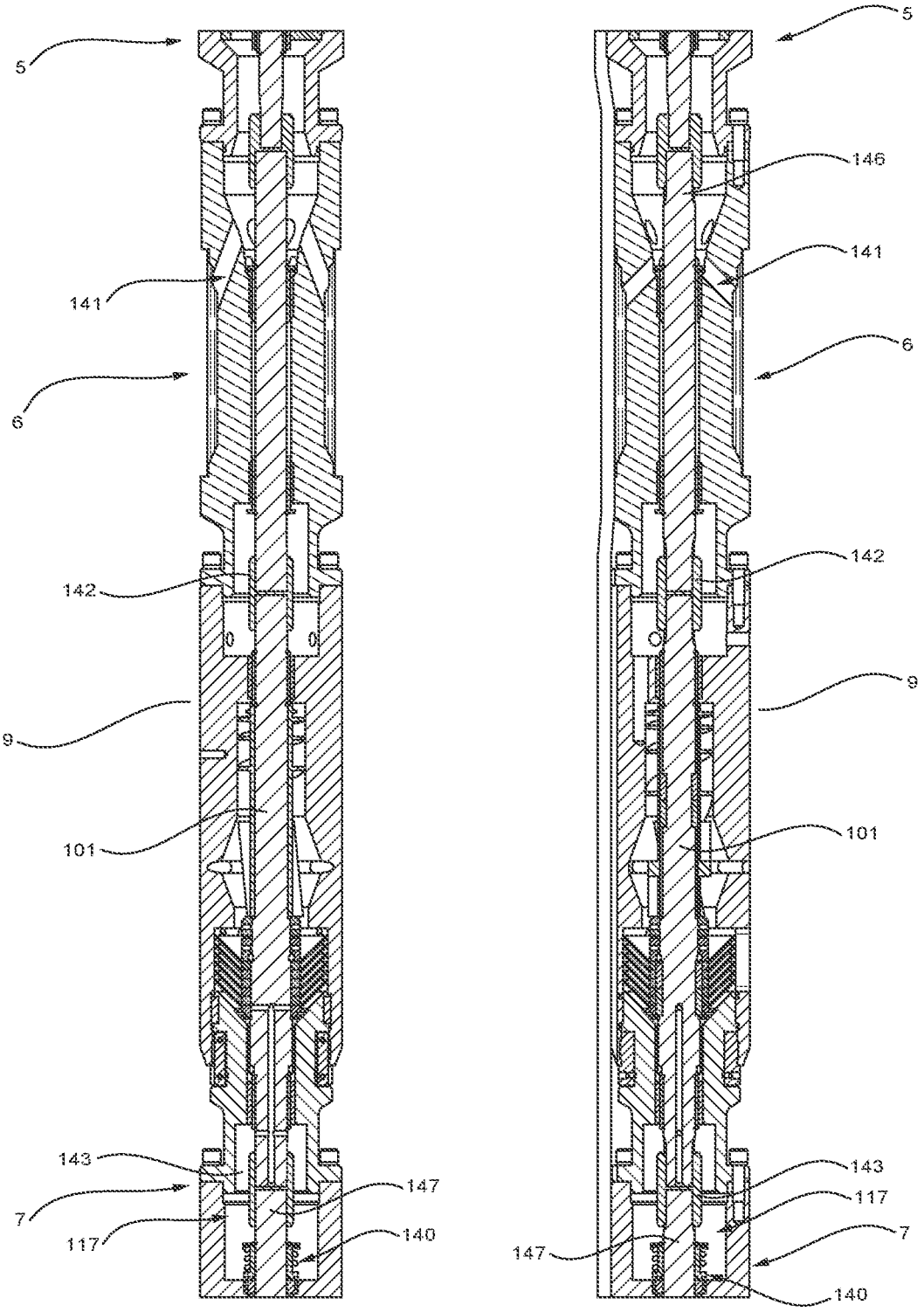
FIG. 6 is a longitudinal section side view of solids separator illustrated in FIG. 3 fitted between the protector 7 and pump inlet 6.
Figure 7:
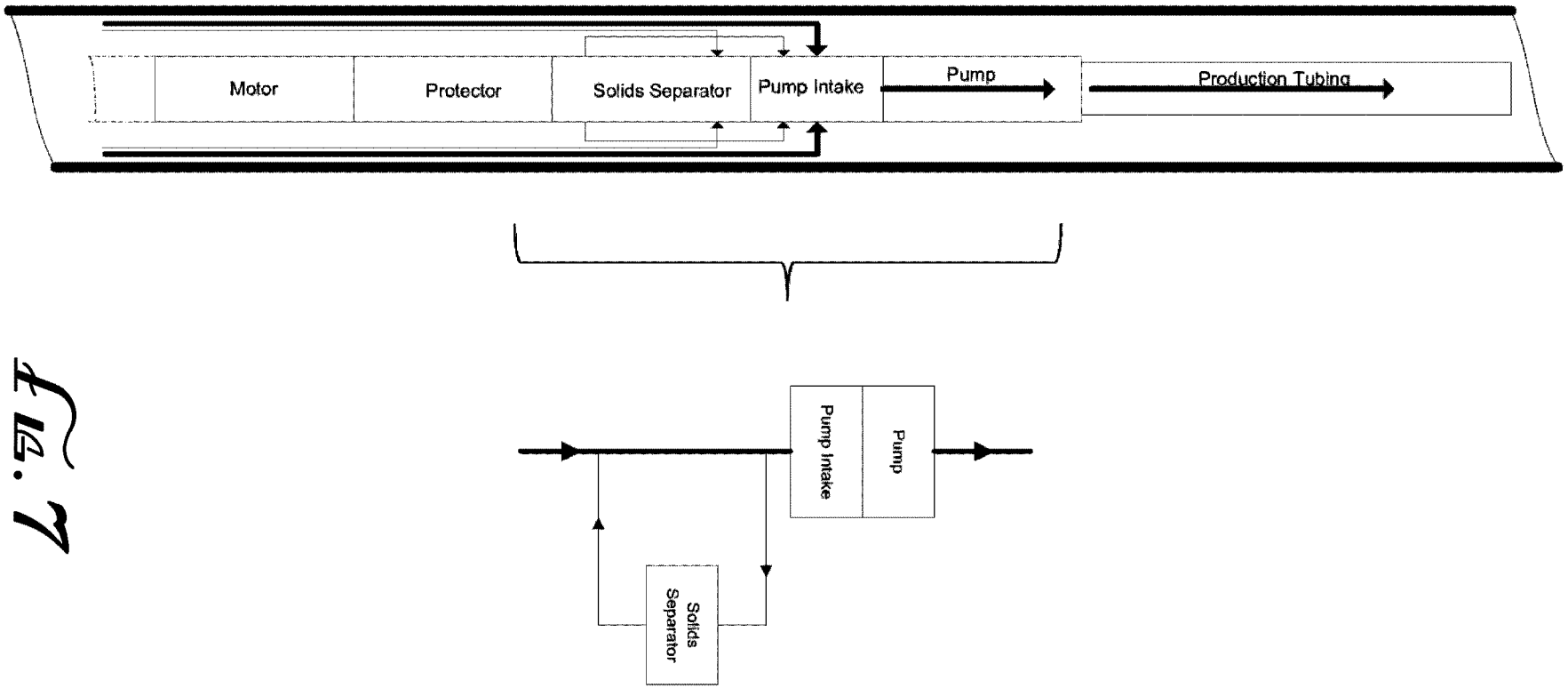
FIG. 7 provides diagrammatic views of the well fluid flow distribution. The solids separator is designed to handle a small amount of fluid regardless of the size of the pump and the protector is protecting. The volume of fluid handled by the solids separator only depends on the speed at the given operating point of the pump.

Referring to FIGS. 6 and 7 there is shown the overall assembly of the ESP string with the solid separator 9 installed. The drive shaft 101, transmitting the power through the solids separator 9, drives the pump intake shaft 146 via a coupling 142. The power is transferred from the shaft 147 of the protector 7 from the motor 10 (shown in FIG. 1) through coupling 143. The mechanical shaft seal 140 of the protector 7 is located in the clean fluid chamber 117. The fluid in the clean fluid chamber 117 is maintained clean by the action of the solid separator 9.

Figure 8A:
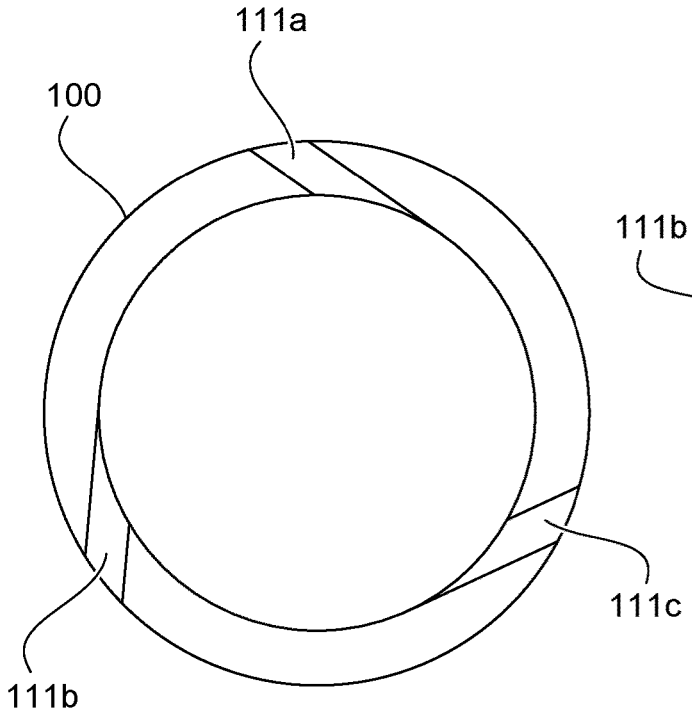
FIG. 8A and FIG. 8B are illustrations of a first plurality of exit ports of the solids separator according to an embodiment of the disclosure.
Figure 8B:
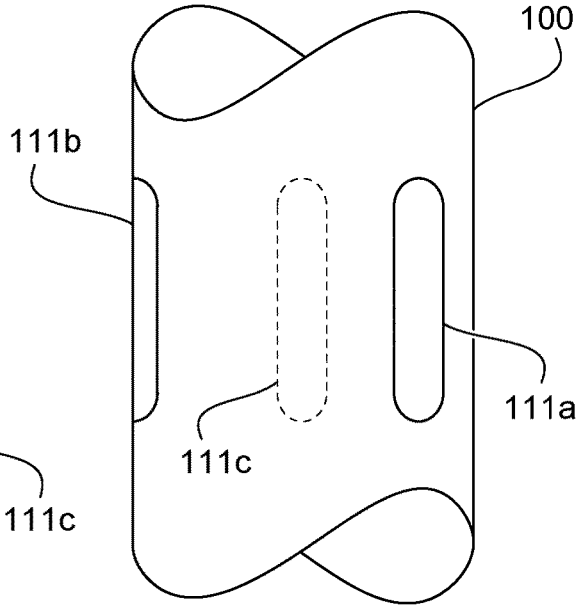

Turning now to FIG. 8A and FIG. 8B, the housing 100 is shown penetrated by the plurality of first exit ports 111*a*, 111*b*, 111*c*. In an embodiment, each of the first plurality of exit ports 111 pass through the housing at an angle, for example at an angle between 25 degrees and 55 degrees versus an outward directed radius from a center of the housing 100 that passes through the interior opening of the exit port 111. In an embodiment, the each of the first plurality of exit ports is oval-shaped with a long axis that aligns with the axis of the solids separator 9. The orientation of the first exit ports 111*a*, 111*b*, 111*c* are aligned with the direction of rotation of the drive shaft 101. As shown in FIG. 8A, the first exit ports 111 are oriented to align with a counterclockwise rotation of the drive shaft 101 as seen from the same view. If the drive shaft 101 were to rotate, instead, in a clockwise direction, the orientation of the first exit ports 111 would shift to make an angle in the opposite sense to the outward directed radius. While three first exit ports 111*a*, 111*b*, 111*c* are shown in FIG. 8A and FIG. 8B, it is understood that there may be a different number of first exit ports 111, for example two first exit ports 111, four first exit ports 111, five first exit ports 111, or a greater number of first exit ports 111.

Figure 9A:
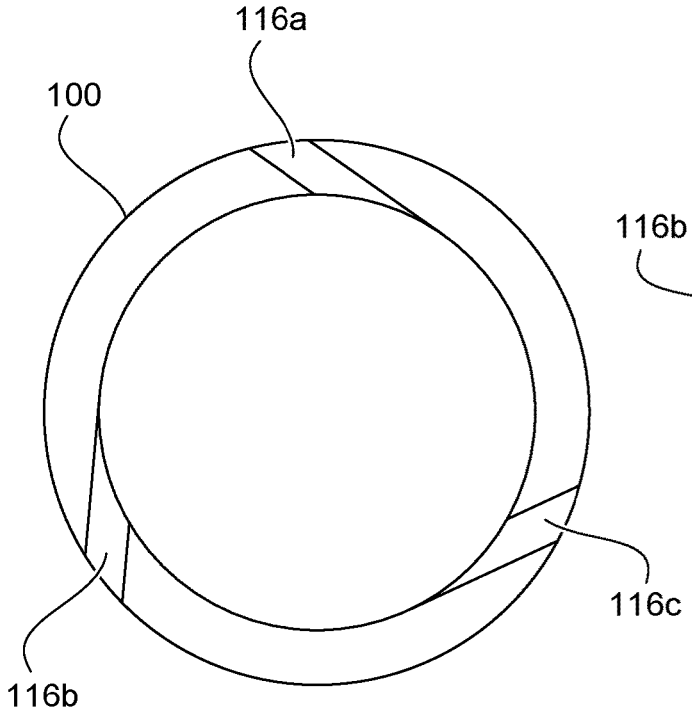
FIG. 9A and FIG. 9B are illustrations of a second plurality of exit ports of the solids separator according to an embodiment of the disclosure.
Figure 9B:
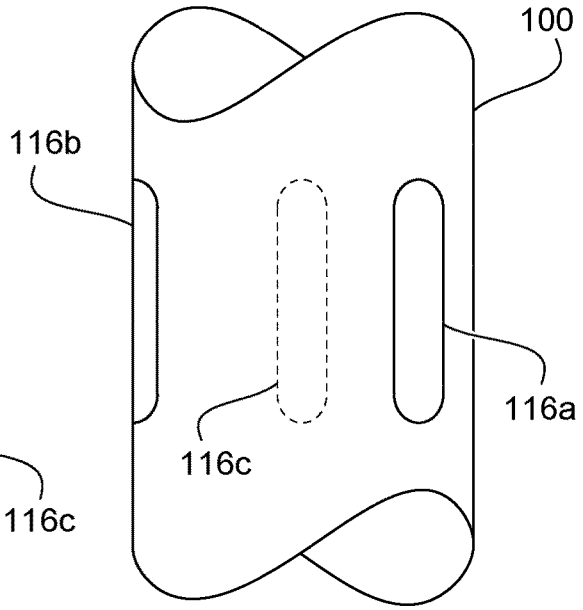

Turning now to FIG. 9A and FIG. 9B, the housing 100 is shown penetrated by the plurality of second exit ports 116*a*, 116*b*, 116*c*. In an embodiment, each of the second plurality of exit ports 116 pass through the housing at an angle, for example at an angle between 25 degrees and 55 degrees versus an outward directed radius from a center of the housing 100 that passes through the interior opening of the exit port 116. In an embodiment, the each of the first plurality of exit ports is oval-shaped with a long axis that aligns with the axis of the solids separator 9. The orientation of the second exit ports 116*a*, 116*b*, 116*c* are aligned with the direction of rotation of the drive shaft 101. As shown in FIG. 9A, the second exit ports 116 are oriented to align with a counterclockwise rotation of the drive shaft 101 as seen from the same view. If the drive shaft 101 were to rotate, instead, in a clockwise direction, the orientation of the second exit ports 116 would shift to make an angle in the opposite sense to the outward directed radius. While three second exit ports 116*a*, 116*b*, 116*c* are shown in FIG. 9A and FIG. 9B, it is understood that there may be a different number of second exit ports 116, for example two second exit ports 116, four second exit ports 116, five second exit ports 116, or a greater number of second exit ports 116

Figure 10:
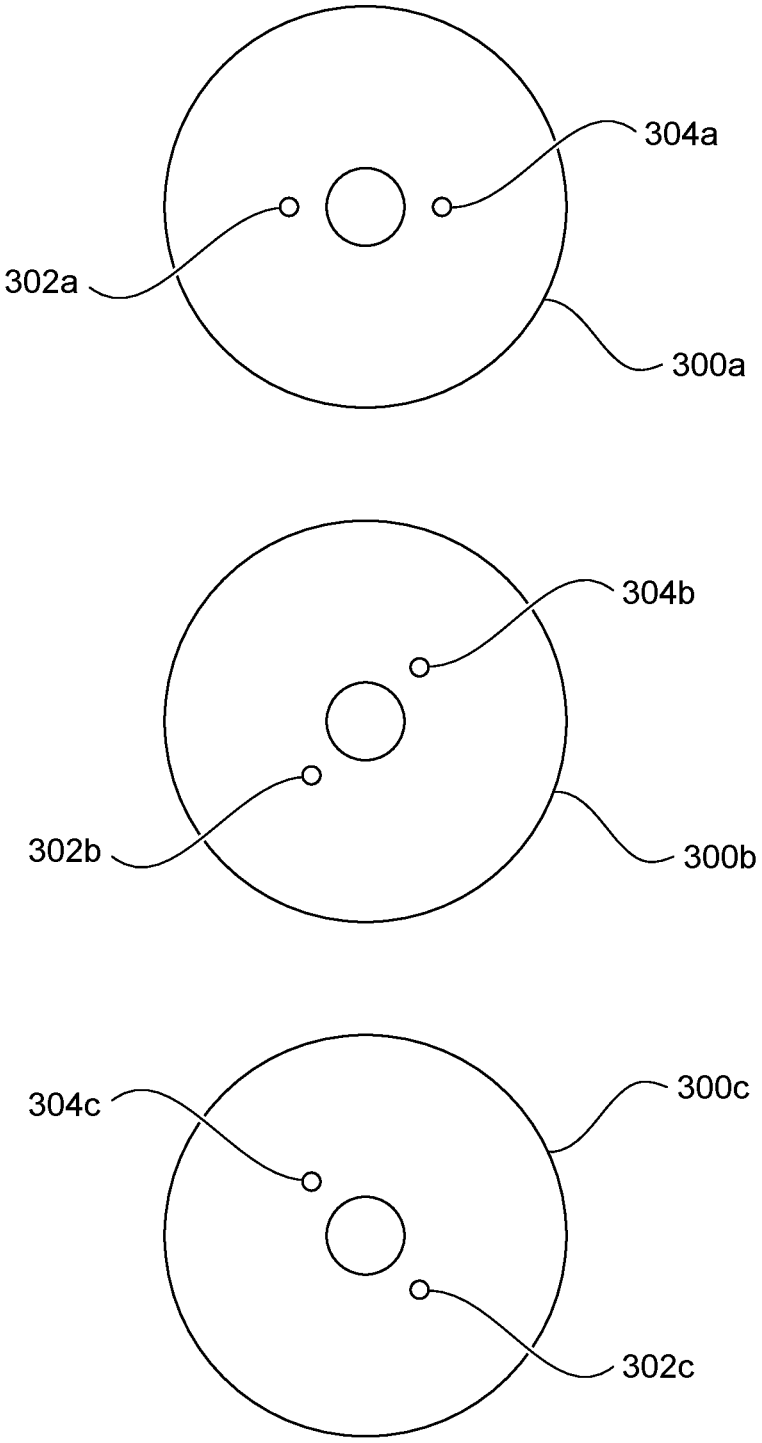
FIG. 10 is an illustration of a plurality of conical bladeless impellers according to an embodiment of the disclosure.

Turning now to FIG. 10, three conical bladeless impellers 300*a*, 300*b*, and 300*c* are described. Each of the conical bladeless impellers 300 define a center aperture for receiving the drive shaft 101. Each of the conical bladeless impellers 300 also define a plurality of apertures 302, 304 located between the center aperture and an outside edge of the conical bladeless impeller 300. While each impeller 300*a*, 300*b*, 300*c* is illustrated in FIG. 10 as having two apertures 302, 304, it is understood that the impellers may have one aperture, three apertures, four apertures, five apertures, six apertures, or some larger number of apertures less than thirty apertures. The apertures 302, 304 may be close to the center aperture without intersecting the center aperture. In an embodiment, the center of the apertures 302, 304 are between a first diameter and the center aperture, where the first diameter is half-way between the center aperture and an outside edge of the conical bladeless impeller 300. In an embodiment, the center of the apertures 302, 304 are between a second diameter and the center aperture, where the second diameter is two fifths (⅖) of the way between the center aperture and an outside edge of the conical bladeless impeller 300. In an embodiment, the center of the apertures 302, 304 are between a third diameter and the center aperture, where the third diameter is one third (⅓) of the way between the center aperture and an outside edge of the conical bladeless impeller 300. In an embodiment, the center of the apertures 302, 304 are between a fourth diameter and the center aperture, where the fourth diameter is one quarter (¼) of the way between the center aperture and an outside edge of the conical bladeless impeller 300. In an embodiment, the center of the apertures 302, 304 are between a fifth diameter and the center aperture, where the fifth diameter is one fifth (⅕) of the way between the center aperture and an outside edge of the conical bladeless impeller 300.

The view of FIG. 10 is showing that the apertures are unaligned when the conical bladeless impellers 300 are stacked and nested as illustrated in FIG. 4. The pattern shown in these three conical bladeless impellers 300*a*, 300*b*, 300*c* may repeat with other one of the conical bladeless impellers 300. In an embodiment, each successive conical bladeless impeller 300 may be rotationally offset by about 60 degrees relative to the conical bladeless impeller 300 disposed downhole of it. In an embodiment, the drive shaft 101 defines keyways at 6 locations offset from each other by 60 degrees rotationally around the drive shaft 101, and the conical bladeless impellers 300 define a slot that aligns with one of the keyways and is secured in position by a key inserted into the aligned keyways.

Figure 11:
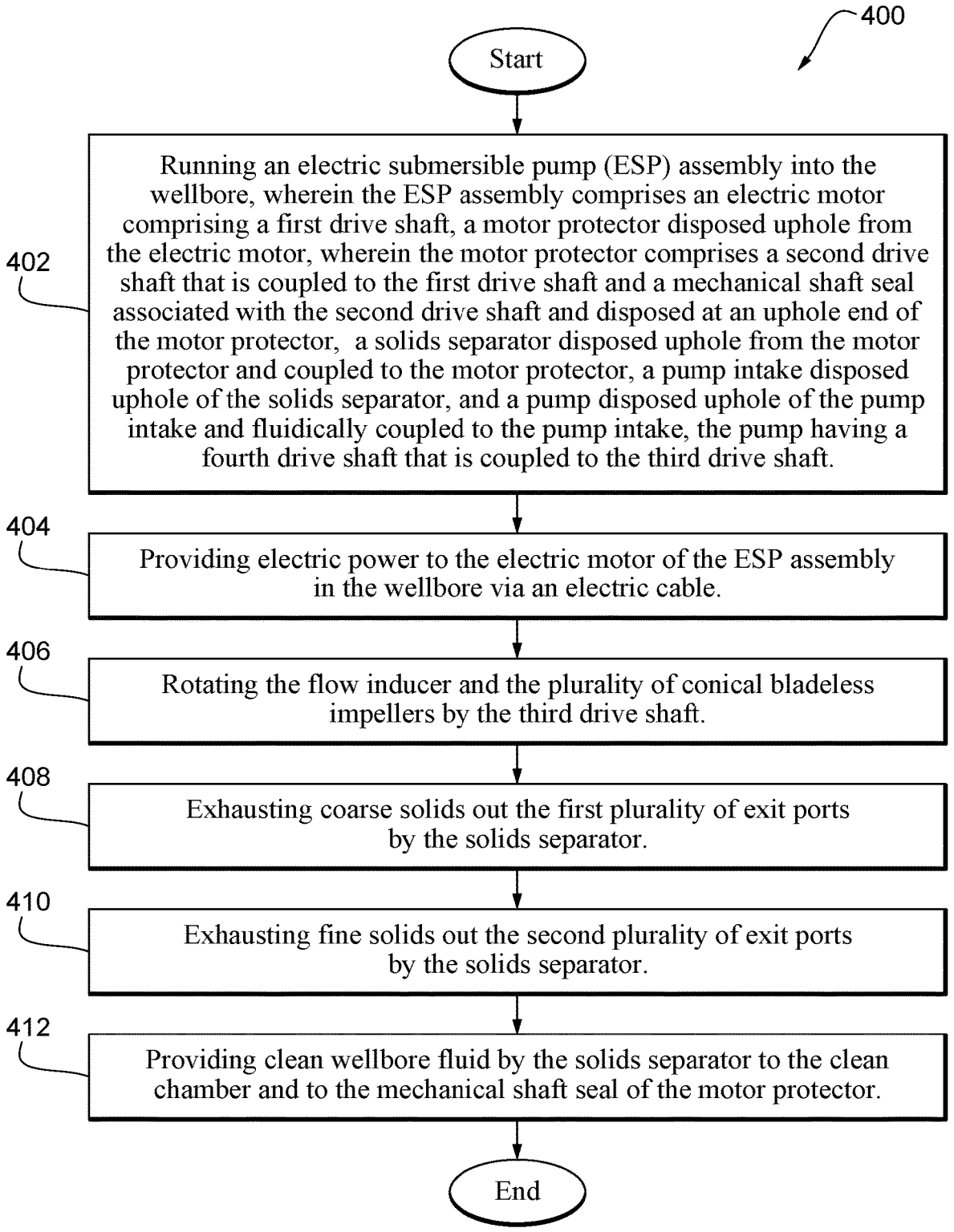
FIG. 11 is a flow chart of a method according to an embodiment of the disclosure.

Turning now to FIG. 11, a method 400 is described. In an embodiment, the method 400 is a method of lifting wellbore fluid up a wellbore to a surface. At block 402, the method 400 comprises running an electric submersible pump (ESP) assembly such as one of the embodiments described above into the wellbore. In an embodiment, the ESP assembly comprises an electric motor comprising a first drive shaft, a motor protector disposed uphole from the electric motor, wherein the motor protector comprises a second drive shaft that is coupled to the first drive shaft and a mechanical shaft seal associated with the second drive shaft and disposed at an uphole end of the motor protector, a solids separator disposed uphole from the motor protector and coupled to the motor protector, wherein the solids separator defines a clean cavity at a downhole end that encloses the mechanical shaft seal of the motor protector and comprises a housing interiorly defining a separation cavity in a middle of the housing, defining a plurality of inlet ports at an uphole end of the housing, defining a first plurality of exit ports located downhole of the inlet ports and contiguous with the separation cavity, and defining a second plurality of exit ports uphole of the clean cavity and downhole of the separation cavity, a third drive shaft coupled to the second drive shaft, a flow inducer coupled to the third drive shaft and located uphole of the separation cavity and downhole of the inlet ports, a fine solids separator coupled to the third drive shaft and located uphole of the clean cavity, downhole of the separation cavity and adjacent to the second plurality of exit ports, wherein the fine solids separator comprises a plurality of conical bladeless impellers coupled to the third drive shaft and sloping downhole away from the third drive shaft, wherein each conical bladeless impeller defines at least one aperture between a central opening of the bladeless impeller that receives the third drive shaft and a point midway outwards from the central opening, a pump intake disposed uphole of the solids separator, and a pump disposed uphole of the pump intake and fluidically coupled to the pump intake, the pump having a fourth drive shaft that is coupled to the third drive shaft.

At block 404, the method 400 comprises providing electric power to the electric motor of the ESP assembly in the wellbore via an electric cable. At block 406, the method 400 comprises rotating the flow inducer and the plurality of conical bladeless impellers by the third drive shaft.

At block 408, the method 400 comprises exhausting coarse solids out the first plurality of exit ports by the solids separator. At block 410, the method 400 comprises exhausting fine solids out the second plurality of exit ports by the solids separator. At block 412, the method 400 comprises providing clean wellbore fluid by the solids separator to the clean chamber and to the mechanical shaft seal of the motor protector.

In an embodiment, the solids separator of the method 400 comprises a base that is coupled to the housing and enclosing the drive shaft, wherein an uphole end of the base defines an upper dam that defines an inner lip encircling the third drive shaft and that slopes away from the inner lip and wherein a downhole end of the base defines the clean cavity; wherein the base retains a bearing bushing that encloses a bearing sleeve coupled to the third drive shaft, wherein the bearing bushing and bearing sleeve are disposed in a bearing chamber defined by the base that is separated by an interior throat of the base from the clean chamber; and wherein the third drive shaft defines an axial bore, a first transverse bore that intersects the axial bore downhole of the bearing bushing and uphole of the throat separating the bearing chamber from the clean chamber, and a second transverse bore that intersects the axial bore uphole of the base and proximate the conical bladeless impellers; further comprising circulating clean wellbore fluid into the first transverse bore, up the axial bore, out the second transverse bore to pass through some of the conical bladeless impellers. In an embodiment, the method 400 further comprising circulating clean fluid between the bearing bushing and the bearing sleeve and into the first transverse bore based on a pressure differential developed between the second transverse bore and the outside edge of the conical bladeless impellers by the rotating of the conical bladeless impellers by the third drive shaft. In an embodiment, the method 400 further comprises, after running the ESP assembly into the wellbore and after providing electric power to the electric motor of the ESP assembly, removing electric power from the electric motor; stopping rotating the flow inducer and the plurality of conical bladeless impellers by the third drive shaft; sloughing off solids that settle onto the uphole surfaces of the conical bladeless impellers outwards to settle downhole inside the housing of the solids separator; and capturing the solids that settle downhole of the conical bladeless impellers inside the housing of the solids separator by the upper dam.

In an embodiment of method 400, the first plurality of exit ports and the second plurality of exit ports pass through the housing at an angle between 25 degrees and 55 degrees versus an outward directed radius from a centerline of the housing, and the method 400 further comprises producing turbulence in the wellbore fluid in an annulus between an outside of the ESP assembly and an inside of the wellbore by the solids separator exhausting wellbore fluid out the first plurality of exit ports and the second plurality of exit ports. In an embodiment, the method 400 further comprises preventing ingesting a slug of solids into the plurality of inlet ports in the solids separator and into the pump intake by the producing turbulence in the wellbore fluid in the annulus.

Figure 12:
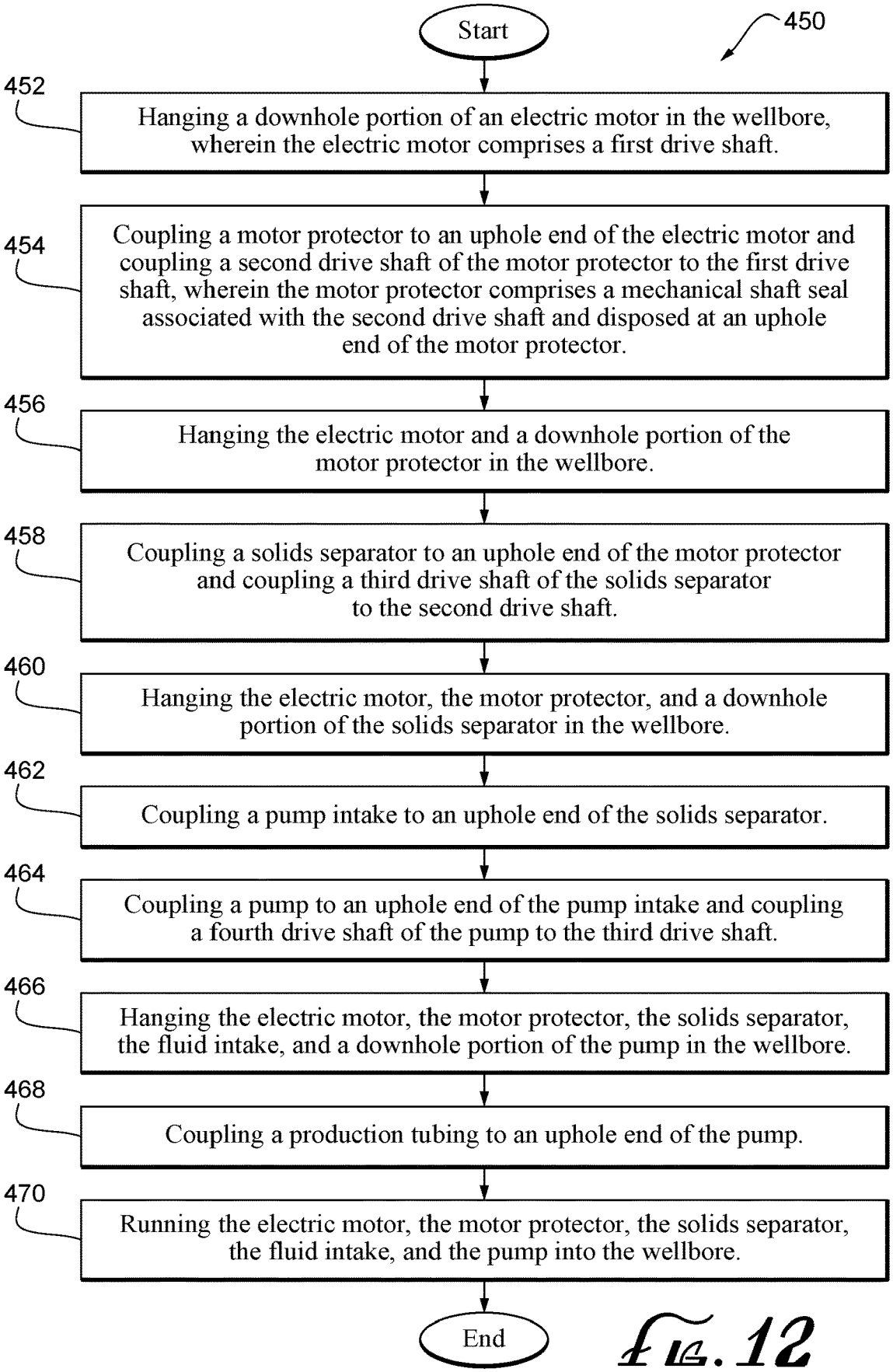
FIG. 12 is a flow chart of another method according to an embodiment of the disclosure.

Turning now to FIG. 12, a method 450 is described. In an embodiment, the method 450 is a method of assembling an electric submersible pump (ESP) assembly at a well site. At block 452, the method 450 comprises hanging a downhole portion of an electric motor in the wellbore, wherein the electric motor comprises a first drive shaft. At block 454, the method 450 comprises coupling a motor protector to an uphole end of the electric motor and coupling a second drive shaft of the motor protector to the first drive shaft, wherein the motor protector comprises a mechanical shaft seal associated with the second drive shaft and disposed at an uphole end of the motor protector. At block 456, the method 450 comprises hanging the electric motor and a downhole portion of the motor protector in the wellbore.

At block 458, the method 450 comprises coupling a solids separator to an uphole end of the motor protector and coupling a third drive shaft of the solids separator to the second drive shaft, wherein the solids separator defines a clean cavity at a downhole end that encloses the mechanical shaft seal of the motor protector and comprises a housing interiorly defining a separation cavity in a middle of the housing, defining a plurality of inlet ports at an uphole end of the housing, defining a first plurality of exit ports located downhole of the inlet ports and contiguous with the separation cavity, and defining a second plurality of exit ports uphole of the clean cavity and downhole of the separation cavity, flow inducer coupled to the third drive shaft and located uphole of the separation cavity and downhole of the inlet ports, a fine solids separator coupled to the third drive shaft and located uphole of the clean cavity, downhole of the separation cavity and adjacent to the second plurality of exit ports, wherein the fine solids separator comprises a plurality of conical bladeless impellers coupled to the third drive shaft and sloping downhole away from the third drive shaft, wherein each conical bladeless impeller defines at least one aperture between a central opening of the bladeless impeller that receives the third drive shaft and a point midway outwards from the central opening.

At block 460, the method 450 comprises hanging the electric motor, the motor protector, and a downhole portion of the solids separator in the wellbore. At block 462, the method 450 comprises coupling a pump intake to an uphole end of the solids separator. At block 464, the method 450 comprises coupling a pump to an uphole end of the pump intake and coupling a fourth drive shaft of the pump to the third drive shaft.

At block 466, the method 450 comprises hanging the electric motor, the motor protector, the solids separator, the fluid intake, and a downhole portion of the pump in the wellbore. At block 468, the method 450 comprises coupling a production tubing to an uphole end of the pump. At block 470, the method 450 comprises running the electric motor, the motor protector, the solids separator, the fluid intake, and the pump into the wellbore. In an embodiment, the method 450 further comprises providing electric power to the electric motor; lifting wellbore fluid up the production tubing by the pump; and capturing the wellbore fluid at a surface at the well site.

In an embodiment, the solids separator of the method 450 comprises a base that is coupled to the housing and enclosing the drive shaft, wherein an uphole end of the base defines an upper dam that defines an inner lip encircling the third drive shaft and that slopes away from the inner lip and wherein a downhole end of the base defines the clean cavity. In an embodiment, the solids separator of the method 450 comprises a helical fluid mover disposed downhole of the fine solids separator that is coupled to the third drive shaft and enclosed by the inner lip of the upper dam. In an embodiment of the method 450, the base retains a bearing bushing that encloses a bearing sleeve coupled to the third drive shaft, wherein the bearing bushing and bearing sleeve are disposed in a bearing chamber defined by the base that is separated by an interior throat of the base from the clean chamber. In an embodiment, of the method 450, the third drive shaft defines an axial bore, a first transverse bore that intersects the axial bore downhole of the bearing bushing and uphole of the throat separating the bearing chamber from the clean chamber, and a second transverse bore that intersects the axial bore uphole of the base and proximate the conical bladeless impellers.

In an embodiment of the method 450, the first plurality of exit ports and the second plurality of exit ports pass through the housing at an angle between 25 degrees and 55 degrees versus an outward directed radius from a centerline of the housing.

What is claimed is:

1. An electric submersible pump system, comprising:

an electric motor comprising a first drive shaft;

a motor protector disposed uphole from the electric motor, wherein the motor protector comprises a second drive shaft that is coupled to the first drive shaft and a mechanical shaft seal associated with the second drive shaft and disposed at an uphole end of the motor protector;

a solids separator disposed uphole from the motor protector and coupled to the motor protector, wherein the solids separator defines a clean cavity at a downhole end that encloses the mechanical shaft seal of the motor protector and comprises a housing interiorly defining a separation cavity in a middle of the housing, defining a plurality of inlet ports at an uphole end of the housing, defining a first plurality of exit ports located downhole of the inlet ports and contiguous with the separation cavity, and defining a second plurality of exit ports uphole of the clean cavity and downhole of the separation cavity, a third drive shaft coupled to the second drive shaft, a base that is coupled to the housing and that encloses the third drive shaft, wherein an uphole end of the base defines an upper dam that defines an inner lip encircling the third drive shaft and that slopes away from the inner lip and wherein a downhole end of the base defines the clean cavity, wherein the base retains a bearing bushing that encloses a bearing sleeve coupled to the third drive shaft, wherein the bearing bushing and bearing sleeve are disposed in a bearing chamber defined by the base that is separated by an interior throat of the base from the clean cavity, a flow inducer coupled to the third drive shaft and located uphole of the separation cavity and downhole of the inlet ports, a fine solids separator coupled to the third drive shaft and located uphole of the clean cavity, downhole of the separation cavity and adjacent to the second plurality of exit ports, wherein the fine solids separator comprises a plurality of conical bladeless impellers coupled to the third drive shaft and sloping downhole away from the third drive shaft, wherein each conical bladeless impeller defines at least one aperture between a central opening of the bladeless impeller that receives the third drive shaft and a point midway outwards from the central opening;

a pump intake disposed uphole of the solids separator; and a pump disposed uphole of the pump intake and fluidically coupled to the pump intake, the pump having a fourth drive shaft that is coupled to the third drive shaft.

2. The electric submersible pump system of claim 1, wherein the solids separator comprises a helical fluid mover disposed downhole of the fine solids separator that is coupled to the third drive shaft and enclosed by the inner lip of the upper dam.

3. The electric submersible pump system of claim 1, wherein the third drive shaft defines an axial bore, a first transverse bore that intersects the axial bore downhole of the bearing bushing and uphole of the throat separating the bearing chamber from the clean cavity, and a second transverse bore that intersects the axial bore uphole of the base and proximate the conical bladeless impellers.

4. The electric submersible pump system of claim 3, wherein the second transverse bore intersects the axial bore between two middle conical bladeless impellers of the plurality of conical bladeless impellers.

5. The electric submersible pump system of claim 1, wherein the base defines a plurality of axial grooves in an interior surface of the base proximate an outside of the bearing bushing.

6. The electric submersible pump system of claim 1, wherein the first plurality of exit ports and the second plurality of exit ports pass through the housing at an angle between 25 degrees and 55 degrees relative to an outward directed radius from a centerline of the housing.

7. The electric submersible pump system of claim 1, wherein at least one of the conical bladeless impellers is rotationally offset relative to one of the plurality of conical bladeless impellers disposed downhole of it.

8. The electric submersible pump system of claim 1, wherein the base defines at least one axial groove in an interior surface of the base proximate an outside of the bearing bushing.

9. A method of lifting wellbore fluid up a wellbore to a surface, comprising:

running an electric submersible pump (ESP) assembly into the wellbore, wherein the ESP assembly comprises an electric motor comprising a first drive shaft, a motor protector disposed uphole from the electric motor, wherein the motor protector comprises a second drive shaft that is coupled to the first drive shaft and a mechanical shaft seal associated with the second drive shaft and disposed at an uphole end of the motor protector, a solids separator disposed uphole from the motor protector and coupled to the motor protector, wherein the solids separator defines a clean cavity at a downhole end that encloses the mechanical shaft seal of the motor protector and comprises a housing interiorly defining a separation cavity in a middle of the housing, defining a plurality of inlet ports at an uphole end of the housing, defining a first plurality of exit ports located downhole of the inlet ports and contiguous with the separation cavity, and defining a second plurality of exit ports uphole of the clean cavity and downhole of the separation cavity, a third drive shaft coupled to the second drive shaft, a base that is coupled to the housing and that encloses the third drive shaft, wherein an uphole end of the base defines an upper dam that defines an inner lip encircling the third drive shaft and that slopes away from the inner lip and wherein a downhole end of the base defines the clean cavity, wherein the base retains a bearing bushing that encloses a bearing sleeve coupled to the third drive shaft, wherein the bearing bushing and bearing sleeve are disposed in a bearing chamber defined by the base that is separated by an interior throat of the base from the clean cavity, a flow inducer coupled to the third drive shaft and located uphole of the separation cavity and downhole of the inlet ports, a fine solids separator coupled to the third drive shaft and located uphole of the clean cavity, downhole of the separation cavity and adjacent to the second plurality of exit ports, wherein the fine solids separator comprises a plurality of conical bladeless impellers coupled to the third drive shaft and sloping downhole away from the third drive shaft, wherein each conical bladeless impeller defines at least one aperture between a central opening of the bladeless impeller that receives the third drive shaft and a point midway outwards from the central opening, wherein the third drive shaft defines an axial bore, wherein the third drive shaft defines a first transverse bore that intersects the axial bore downhole of the bearing bushing and uphole of the throat separating the bearing chamber from the clean cavity, and wherein the third drive shaft defines a second transverse bore that intersects the axial bore uphole of the base and proximate the conical bladeless impellers, a pump intake disposed uphole of the solids separator, and a pump disposed uphole of the pump intake and fluidically coupled to the pump intake, the pump having a fourth drive shaft that is coupled to the third drive shaft;

providing electric power to the electric motor of the ESP assembly in the wellbore via an electric cable;

rotating the flow inducer and the plurality of conical bladeless impellers by the third drive shaft;

exhausting coarse solids out the first plurality of exit ports via the solids separator;

exhausting fine solids out the second plurality of exit ports via the solids separator;

providing clean wellbore fluid via the solids separator to the clean cavity and to the mechanical shaft seal of the motor protector; and circulating clean wellbore fluid into the first transverse bore, up the axial bore, out the second transverse bore to pass through some of the conical bladeless impellers.

10. The method of claim 9, further comprising circulating clean fluid between the bearing bushing and the bearing sleeve and into the first transverse bore based on a pressure differential developed between the second transverse bore and an outside edge of the conical bladeless impellers by the rotating of the conical bladeless impellers by the third drive shaft.

11. The method of claim 9, further comprising:

after running the ESP assembly into the wellbore and after providing electric power to the electric motor of the ESP assembly, removing electric power from the electric motor;

stopping rotating the flow inducer and the plurality of conical bladeless impellers by the third drive shaft;

sloughing off solids that settle onto an uphole surfaces of each of the conical bladeless impellers outwards to settle downhole inside the housing of the solids separator; and capturing the solids that settle downhole of the conical bladeless impellers inside the housing of the solids separator by the upper dam.

12. The method of claim 9, wherein the first plurality of exit ports and the second plurality of exit ports pass through the housing at an angle between 25 degrees and 55 degrees relative to an outward directed radius from a centerline of the housing, further comprising producing turbulence in the wellbore fluid in an annulus between an outside of the ESP assembly and an inside of the wellbore by the solids separator exhausting wellbore fluid out the first plurality of exit ports and the second plurality of exit ports.

13. The method of claim 12, further comprising preventing ingesting a slug of solids into the plurality of inlet ports in the solids separator and into the pump intake by the producing turbulence in the wellbore fluid in the annulus.

14. A method of assembling an electric submersible pump (ESP) assembly at a well site, comprising:

hanging a downhole portion of an electric motor in a wellbore, wherein the electric motor comprises a first drive shaft;

coupling a motor protector to an uphole end of the electric motor and coupling a second drive shaft of the motor protector to the first drive shaft, wherein the motor protector comprises a mechanical shaft seal associated with the second drive shaft and disposed at an uphole end of the motor protector;

hanging the electric motor and a downhole portion of the motor protector in the wellbore;

coupling a solids separator to an uphole end of the motor protector and coupling a third drive shaft of the solids separator to the second drive shaft, wherein the solids separator defines a clean cavity at a downhole end that encloses the mechanical shaft seal of the motor protector and comprises a housing interiorly defining a separation cavity in a middle of the housing, defining a plurality of inlet ports at an uphole end of the housing, defining a first plurality of exit ports located downhole of the inlet ports and contiguous with the separation cavity, and defining a second plurality of exit ports uphole of the clean cavity and downhole of the separation cavity, a flow inducer coupled to the third drive shaft and located uphole of the separation cavity and downhole of the inlet ports, a fine solids separator coupled to the third drive shaft and located uphole of the clean cavity, downhole of the separation cavity and adjacent to the second plurality of exit ports, wherein the fine solids separator comprises a plurality of conical bladeless impellers coupled to the third drive shaft and sloping downhole away from the third drive shaft, wherein each conical bladeless impeller defines at least one aperture between a central opening of the bladeless impeller that receives the third drive shaft and a point midway outwards from the central opening, wherein the solids separator comprises a base that is coupled to the housing and that encloses the third drive shaft, wherein an uphole end of the base defines an upper dam that defines an inner lip encircling the third drive shaft and that slopes away from the inner lip and wherein a downhole end of the base defines the clean cavity, wherein the base retains a bearing bushing that encloses a bearing sleeve coupled to the third drive shaft, and wherein the bearing bushing and bearing sleeve are disposed in a bearing chamber defined by the base that is separated by an interior throat of the base from the clean cavity;

hanging the electric motor, the motor protector, and a downhole portion of the solids separator in the wellbore;

coupling a pump intake to an uphole end of the solids separator;

coupling a pump to an uphole end of the pump intake and coupling a fourth drive shaft of the pump to the third drive shaft;

hanging the electric motor, the motor protector, the solids separator, the pump intake, and a downhole portion of the pump in the wellbore; coupling a production tubing to an uphole end of the pump; and running the electric motor, the motor protector, the solids separator, the pump intake, and the pump into the wellbore.

15. The method of claim 14, further comprising:

providing electric power to the electric motor;

lifting wellbore fluid up the production tubing by via the pump; and capturing the wellbore fluid at a surface at the well site.

16. The method of claim 14, wherein the base at least one axial grooves in an interior surface of the base proximate an outside of the bearing bushing.

17. The method of claim 14, wherein the third drive shaft defines an axial bore, a first transverse bore that intersects the axial bore downhole of the bearing bushing and uphole of the throat separating the bearing chamber from the clean cavity, and a second transverse bore that intersects the axial bore uphole of the base and proximate the conical bladeless impellers.

18. The method of claim 14, wherein the first plurality of exit ports and the second plurality of exit ports pass through the housing at an angle between 25 degrees and 55 degrees relative to an outward directed radius from a centerline of the housing.

19. An electric submersible pump system, comprising:

an electric motor comprising a first drive shaft;

a motor protector disposed uphole from the electric motor, wherein the motor protector comprises a second drive shaft that is coupled to the first drive shaft and a mechanical shaft seal associated with the second drive shaft and disposed at an uphole end of the motor protector;

a solids separator disposed uphole from the motor protector and coupled to the motor protector, wherein the solids separator defines a clean cavity at a downhole end that encloses the mechanical shaft seal of the motor protector and comprises a housing interiorly defining a separation cavity in a middle of the housing, defining a plurality of inlet ports at an uphole end of the housing, defining a first plurality of exit ports located downhole of the inlet ports and contiguous with the separation cavity, and defining a second plurality of exit ports uphole of the clean cavity and downhole of the separation cavity, a third drive shaft coupled to the second drive shaft, a base that is coupled to the housing and that encloses the third drive shaft, wherein an uphole end of the base defines an upper dam that defines an inner lip encircling the third drive shaft and that slopes away from the inner lip and wherein a downhole end of the base defines the clean cavity, a flow inducer coupled to the third drive shaft and located uphole of the separation cavity and downhole of the inlet ports, a fine solids separator coupled to the third drive shaft and located uphole of the clean cavity, downhole of the separation cavity and adjacent to the second plurality of exit ports, wherein the fine solids separator comprises a plurality of conical bladeless impellers coupled to the third drive shaft and sloping downhole away from the third drive shaft, wherein each conical bladeless impeller defines at least one aperture between a central opening of the bladeless impeller that receives the third drive shaft and a point midway outwards from the central opening, and a helical fluid mover disposed downhole of the fine solids separator that is coupled to the third drive shaft and enclosed by the inner lip of the upper dam;

a pump intake disposed uphole of the solids separator; and a pump disposed uphole of the pump intake and fluidically coupled to the pump intake, the pump having a fourth drive shaft that is coupled to the third drive shaft.

20. The electric submersible pump system of claim 19, wherein the third drive shaft defines an axial bore, a first transverse bore that intersects the axial bore downhole of a bearing bushing and uphole of a throat separating a bearing chamber from the clean cavity, and a second transverse bore that intersects the axial bore uphole of the base and proximate the conical bladeless impellers.

21. The electric submersible pump system of claim 20, wherein the second transverse bore intersects the axial bore between two middle conical bladeless impellers of the plurality of conical bladeless impellers.

22. The electric submersible pump system of claim 19, wherein at least some one of the conical bladeless impellers are is rotationally offset relative to one of the plurality of conical bladeless impellers disposed downhole of it.

23. The electric submersible pump system of claim 19, wherein the base defines at least one axial groove in an interior surface of the base proximate an outside of a bearing bushing.

* * * * *